US008624575B2

(12) United States Patent
Huang

(10) Patent No.: US 8,624,575 B2
(45) Date of Patent: Jan. 7, 2014

(54) VOLTAGE STABILIZING CIRCUIT

(75) Inventor: Yong-Zhao Huang, Shenzhen (CN)

(73) Assignees: Hong Fu Jin Precision Industry (ShenZhen) Co., Ltd, Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 356 days.

(21) Appl. No.: 12/980,380

(22) Filed: Dec. 29, 2010

(65) Prior Publication Data

US 2012/0146612 A1 Jun. 14, 2012

(30) Foreign Application Priority Data

Dec. 13, 2010 (CN) ..... 2010 1 0584934

(51) Int. Cl.
*G05F 3/22* (2006.01)

(52) U.S. Cl.
USPC ..... 323/311

(58) Field of Classification Search
USPC ..... 323/226, 229, 273–281, 303, 311–317, 323/907
See application file for complete search history.

(56) References Cited

U.S. PATENT DOCUMENTS

| | | | | |
|---|---|---|---|---|
| 3,244,949 | A * | 4/1966 | Hilbiber | 257/577 |
| 4,093,907 | A * | 6/1978 | Nutz | 323/315 |
| 4,313,082 | A * | 1/1982 | Neidorff | 323/312 |
| 4,398,142 | A * | 8/1983 | Beasom | 323/226 |
| 6,563,713 | B2 * | 5/2003 | Yang | 361/752 |
| 7,034,618 | B2 * | 4/2006 | Barabash | 330/289 |
| 7,095,282 | B2 * | 8/2006 | Barabash | 330/289 |
| 7,310,015 | B2 * | 12/2007 | Jeon et al. | 327/538 |
| 8,339,103 | B2 * | 12/2012 | Buchholz et al. | 320/134 |

FOREIGN PATENT DOCUMENTS

CN 201215989 Y 4/2009

* cited by examiner

*Primary Examiner* — Adolf Berhane
*Assistant Examiner* — Jye-June Lee
(74) *Attorney, Agent, or Firm* — Altis Law Group, Inc.

(57) ABSTRACT

A voltage stabilizing circuit including an input port, an output port, a transistor, a diode, a three-terminal voltage regulating reference source, a first resistor, and a second resistor. The transistor has a collector terminal and an emitter terminal connected to the input port and the output port, respectively. The diode has an anode connected to the input port and a base terminal of the transistor. The three-terminal voltage regulating reference source has an anode connected to ground, a cathode connected to the input port and a cathode of the diode, and a reference terminal The first resistor is connected between the cathode of the diode and the reference terminal of the three-terminal voltage regulating reference source. The second resistor is connected between ground and the reference terminal of the three-terminal voltage regulating reference source.

2 Claims, 1 Drawing Sheet

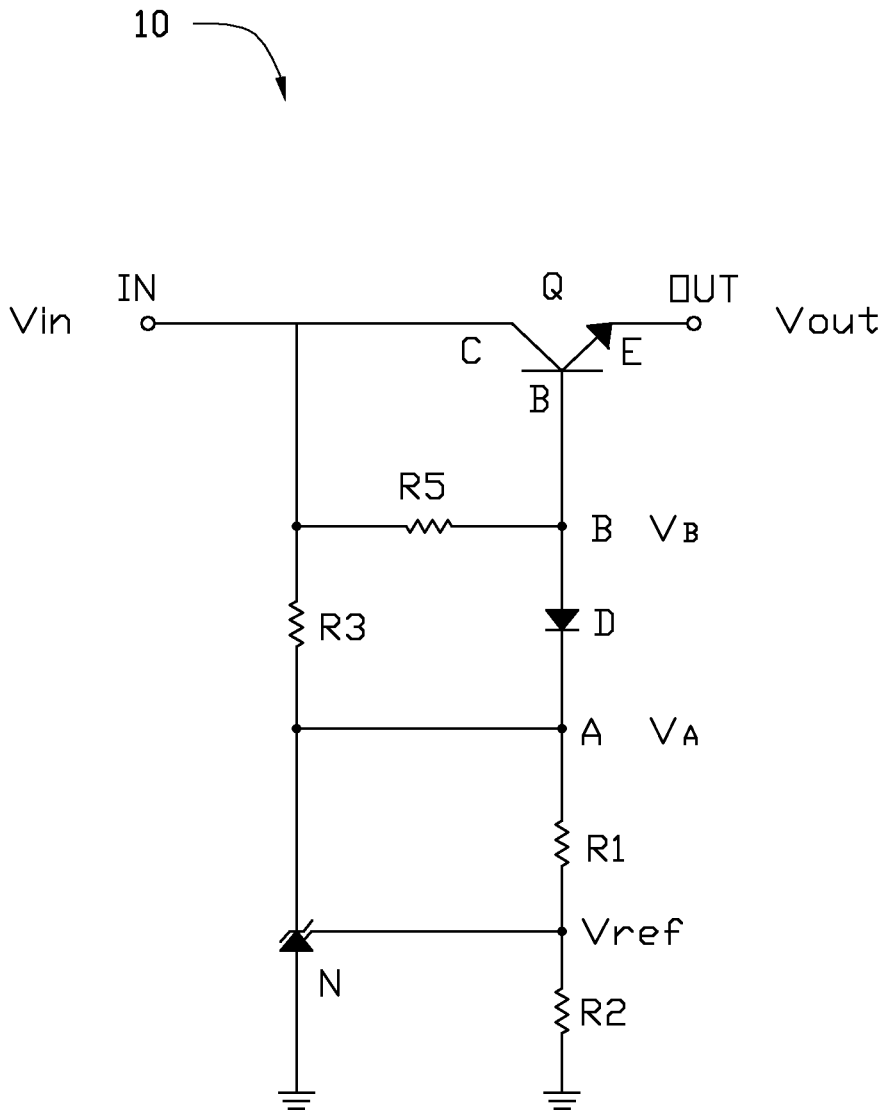
10
IN
Vin
Q
OUT
Vout
C
E
B
R5
B
VB
R3
D
A
VA
R1
Vref
N
R2

VOLTAGE STABILIZING CIRCUIT

BACKGROUND

1. Technical Field

The present disclosure generally relates to voltage stabilizing circuits, and particularly to a voltage stabilizing circuit with high resistance to changes in temperatures.

2. Description of Related Art

Voltage stabilizing circuits are used extensively in electrical equipment. General voltage stabilizing circuits employ a voltage regulator and transistors to stabilize voltage. However, because of the effect of temperature variation in the transistors, the precision of the voltage stabilizing circuits is unsatisfactorily degraded.

Therefore, what is needed is to provide a more reliable voltage stabilizing circuit.

BRIEF DESCRIPTION OF THE DRAWINGS

Many aspects of the disclosure can be better understood with reference to the following drawing. The components in the drawing are not necessarily drawn to scale, the emphasis instead being placed upon clearly illustrating the principles of the disclosure.

The drawing is a circuit diagram of a voltage stabilizing circuit of the present disclosure.

DETAILED DESCRIPTION

Reference will now be made to the drawing to describe the present voltage stabilizing circuit, in detail.

Referring to the drawing, a voltage stabilizing circuit 10 according to an exemplary embodiment includes an input port IN, an output port OUT, a transistor Q, a diode D, and a three-terminal voltage regulating reference source N. The transistor Q includes a base terminal, a collector terminal, and an emitter terminal. The diode D includes an anode and a cathode. The three-terminal voltage regulating reference source N includes an anode, a cathode, and a reference terminal.

The collector terminal and the emitter terminal of the transistor Q are connected between the input port IN and the output port OUT. The transistor Q performs a current amplifying function, thereby improving load capacity of the voltage stabilizing circuit 10. In this embodiment, the transistor Q is an npn type transistor with the collector terminal connected to the input port IN, the emitter terminal connected to the output port OUT, and the base terminal connected to an anode of the diode D. For applying a reverse bias to the PN junction between the collector terminal and the base terminal, the base terminal of the transistor Q is connected to the input port IN by a resistor R5.

The diode D is connected between the base terminal of the transistor Q and a cathode of the three-terminal voltage regulating reference source N. The anode of the diode D is connected to the base terminal of the transistor Q, thereby defining a node B. The cathode of the diode D is connected to the cathode of the three-terminal voltage regulating reference source N, thereby defining a node A.

The reference source N is connected between the input port IN and the cathode of the diode D. Specifically, the anode of the reference source N is connected to ground, the cathode of the reference source N is connected to the cathode of the diode D and the input port IN. The reference terminal of the reference source N is configured for providing a constant reference voltage $V_{ref}$. The reference terminal of the reference source N is connected to the node between resistor R1 and resistor R2. The resistor R1 has another terminal connected to the cathode of the diode D. The resistor R2 has another terminal connected to ground. The resistors R1 and R2 perform a voltage dividing function. A desired reference voltage can be obtained by adjusting resistance ratio of the resistors R1 and R2. In this embodiment, the cathode of the reference source N is connected to the input port IN by a resistor R3, which performs a current limiting function. Specifically, the reference source N is a TL431 voltage regulator.

A voltage drop between the node B and the output port OUT is equivalent to a forward voltage $V_{PN}$ of the PN junction between the collector terminal and the base terminal of the transistor Q. That is, the voltage $V_B$ of the node B and the voltage $V_{out}$ of the output port OUT satisfy: $V_{out}=V_B-V_{PN}$.

A voltage drop between the node B and the node A is equivalent to a forward voltage $V_{PN}$ of the PN junction of the diode D. That is, the voltage $V_B$ the voltage $V_A$ satisfy: $V_A=V_B-V_{PN}$.

It can be deducted that $$V_{out} = V_A = \left(1 + \frac{R1}{R2}\right)V_{ref}.$$

That is, no matter how remarkably the temperature varies, the effect of the variation on a forward flow voltage drop of the transistor Q can be counteracted by the effect of temperature variation on a forward flow voltage drop of the diode D. The voltage $V_{out}$ of the output port OUT will not be affected by temperature variation.

It is to be noted that, the reference source N is not limited to be a TL431 voltage regulator, but can also be some other type of voltage regulator capable of providing a suitable adjustable reference voltage.

It is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. A voltage stabilizing circuit comprising:

an input port and an output port;

an NPN transistor with a base terminal, a collector terminal and an emitter terminal, the collector terminal and emitter terminal being connected to the input port and the output port, respectively;

a diode with an anode and a cathode, the anode of the diode being connected to the base terminal of the transistor;

a three-terminal voltage regulating reference source with an anode connected to ground, a cathode connected to the input port, and a reference terminal;

a first resistor connected between the cathode of the diode and the reference terminal of the three-terminal voltage regulating reference source; and a second resistor connected between ground and the reference terminal of the three-terminal voltage regulating reference source wherein the base terminal of the transistor is connected to the input port by a first current limiting circuit;

wherein the first current limiting circuit comprises a third resistor;

wherein the cathode of the three-terminal voltage regulating reference source is connected to the input port by a second current limiting circuit; and wherein the second current limiting circuit comprises a fourth resistor, a terminal of the fourth resistor is connected to the input port and a terminal of the third resistor, and another terminal of the fourth resistor is connected to the cathode of the three-terminal voltage regulating reference source and the cathode of the diode.

2. The voltage stabilizing circuit according to claim 1, wherein the three-terminal voltage regulating reference source is a TL431 voltage regulator.

* * * * *